US008389915B2

(12) United States Patent
Taylor et al.

(10) Patent No.: US 8,389,915 B2
(45) Date of Patent: Mar. 5, 2013

(54) MICROWAVEABLE POUCH CAPABLE OF CONTROLLED RESPIRATION FOR EXTENDED SHELF LIFE OF PRODUCE CONTAINED THEREIN

(75) Inventors: Michael Allen Taylor, Orillia (CA); Christian von Glasow, St-Lambert (CA)

(73) Assignee: Ultraperf Technologies Inc., St-Jean-sur-Richelieu, QC (CA)

( * ) Notice: Subject to any disclaimer, the term of this patent is extended or adjusted under 35 U.S.C. 154(b) by 503 days.

(21) Appl. No.: 12/650,262

(22) Filed: Dec. 30, 2009

(65) Prior Publication Data

US 2010/0170894 A1 Jul. 8, 2010

Related U.S. Application Data

(60) Provisional application No. 61/203,787, filed on Dec. 30, 2008.

(51) Int. Cl.
*H05B 6/80* (2006.01)

(52) U.S. Cl. ..... 219/725; 219/727; 219/730; 219/735

(58) Field of Classification Search ..... 219/725, 219/727, 730, 735
See application file for complete search history.

(56) References Cited

U.S. PATENT DOCUMENTS

| | | | | |
|---|---|---|---|---|
| 7,077,923 | B2 | 7/2006 | Lin | |
| 7,208,215 | B2 | 4/2007 | Lin | |
| 7,262,393 | B2 | 8/2007 | Ishii et al. | |
| 7,573,010 | B2 * | 8/2009 | Cole | 219/725 |
| 2005/0040161 | A1 | 2/2005 | Lin et al. | |
| 2006/0035777 | A1 | 2/2006 | Johnson | |
| 2007/0039951 | A1 * | 2/2007 | Cole | 219/725 |
| 2007/0087096 | A1 * | 4/2007 | Mir | 426/415 |
| 2007/0269553 | A1 | 11/2007 | Le et al. | |
| 2008/0087664 | A1 * | 4/2008 | Robison et al. | 219/727 |
| 2008/0220212 | A1 | 9/2008 | Lin et al. | |
| 2009/0272736 | A1 * | 11/2009 | Cole | 219/730 |
| 2011/0233202 | A1 * | 9/2011 | Robison et al. | 219/730 |
| 2012/0085754 | A1 * | 4/2012 | Mir | 219/725 |
| 2012/0100265 | A1 * | 4/2012 | Lafferty | 426/107 |

FOREIGN PATENT DOCUMENTS

| | | |
|---|---|---|
| AU | 780966 | 12/2001 |

* cited by examiner

*Primary Examiner* — Ngan Ngo
(74) *Attorney, Agent, or Firm* — Benoît & Côté

(57) ABSTRACT

The present document describes a cooking container for foodstuff in the form of a pouch made of a microwaveable heat-sealable polyester film. The polyester film comprises micro-perforations allowing controlled respiration of the film while maintaining atmospheric pressure inside the pouch.

20 Claims, 9 Drawing Sheets

120

MICROWAVEABLE POUCH CAPABLE OF CONTROLLED RESPIRATION FOR EXTENDED SHELF LIFE OF PRODUCE CONTAINED THEREIN

CROSS-REFERENCE TO RELATED APPLICATIONS

This application claims priority under 35USC§119(e) of U.S. provisional patent application 61/203,787, filed Dec. 30, 2008 and entitled "Microwaveable, reclosable, bag or pouch capable of controlled respiration for extended shelf like with a predetermined steam vent position during the cooking process", the specification of which is hereby incorporated by reference.

TECHNICAL FIELD

This description relates to bag or pouch packaging for storing foodstuff such as perishables for relatively long periods. More particularly, the present specification relates to polymer-based pouches adapted to be heated or microwave to cook the foodstuff stored therein.

BACKGROUND

Prior art plastic bags or pouches employed by food distributors or sellers to contain foodstuff which have a limited shelf life, are typically made of a plastic which is either impermeable to air and liquid or impermeable to liquid but permeable to air. When permeable to air, however, such containers typically allow the passage of humidity therethrough without any control whatsoever. The foodstuff, with time therefore takes on humidity or dries. Some food produce are best kept when their humidity level remains at a certain level. Conserving such humidity level is thus a key factor in maximizing non-freezing shelf life of those food produce.

In addition to preserving freshness of food for as long as possible, food distributors and sellers wish to offer customers ease of food preparation. In doing so, a trend has been set to provide food packaging which is also adapted to microwave cooking. Typical microwaveable food containers available today are however made of air permeable material which present perforations too large to be capable of maintaining a given humidity level and pressure inside the container; and therefore not also adapted to increase the food produce shelf life.

There is therefore a need for improved cooking container adapted to also maximize the foodstuff's shelf life.

SUMMARY

The present disclosure therefore seeks to provide a container for food stuff that addresses one or more disadvantages associated with the prior art, or at least provides a useful alternative thereto.

According to an embodiment, there is provided a cooking container for foodstuff in the form of a pouch made of a microwaveable heat-sealable polyester film. The polyester film comprises micro-perforations allowing controlled respiration of the film while maintaining atmospheric pressure inside the pouch.

According to another embodiment, there is provided a container for foodstuff in the form of a pouch made of a heat-sealable polyester film. The polyester film comprising micro-perforations allowing controlled respiration of the film while maintaining atmospheric pressure inside the pouch.

The container comprises a polyolefin-based reclosable zipper adhered to the film to allow re-sealing of the container.

In the present specification, the expression "heat-sealed polyester film" is intended to refer to a breathable, flexible material resistant to cooking in the microwave. A "heat-sealed polyester film" is, in one embodiment, a single layer of polyester film such as amorphous polyester; or, in another example, a laminate including a polyester film with a coating adapted to be heated. An example of such a two layer laminate is the laminating of a layer of Biaxially-oriented polyethylene terephthalate (boPET) such as Mylar™, with a coating layer of a heat-sealant material or compound (Cast Polypropylene).

In the present specification, the expression "closable seal" is intended to refer to any type of structure which allows for the closing or re-closing of the pouch at a seal. Examples include, but are not limited to, zipper structures such as retort zippers and zippers made out of PET polyolefin material, the latter being better suited for microwaving.

In the present specification, the expression "controlled respiration" or "controlled respiration rate" is intended to refer to the control of the amount of gas that is allowed to pass through a film material. A sealed container made of such breathable film material is able to control the amount of humidity which is allowed to enter and escape from the interior volume of the container, while permitting oxygen and carbon dioxide to pass through adequately. Foodstuff stored in the interior volume of such a container is able to breathe according to a controlled respiration rate; the rate being dependent on a specific design of the perforations in the film material which allow such breathing to take place. Such control on the composition of the gazes which is permitted to enter and escape the sealed container similarly provides for the control of the internal pressure inside such container. The gazeous composition inside the package may therefore be different than it is outside the package (e.g., oxygen levels can be lower inside than outside the package).

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

There is generally described below, with reference to the appended drawings a food container adapted for cooking. As seen first in FIG. 1, the food container 100 takes the form of a bag or a pouch package made of a heat-sealable polyester film 102 comprising micro-perforations allowing controlled respiration of the film while maintaining atmospheric pressure inside the pouch.

Figure 1:
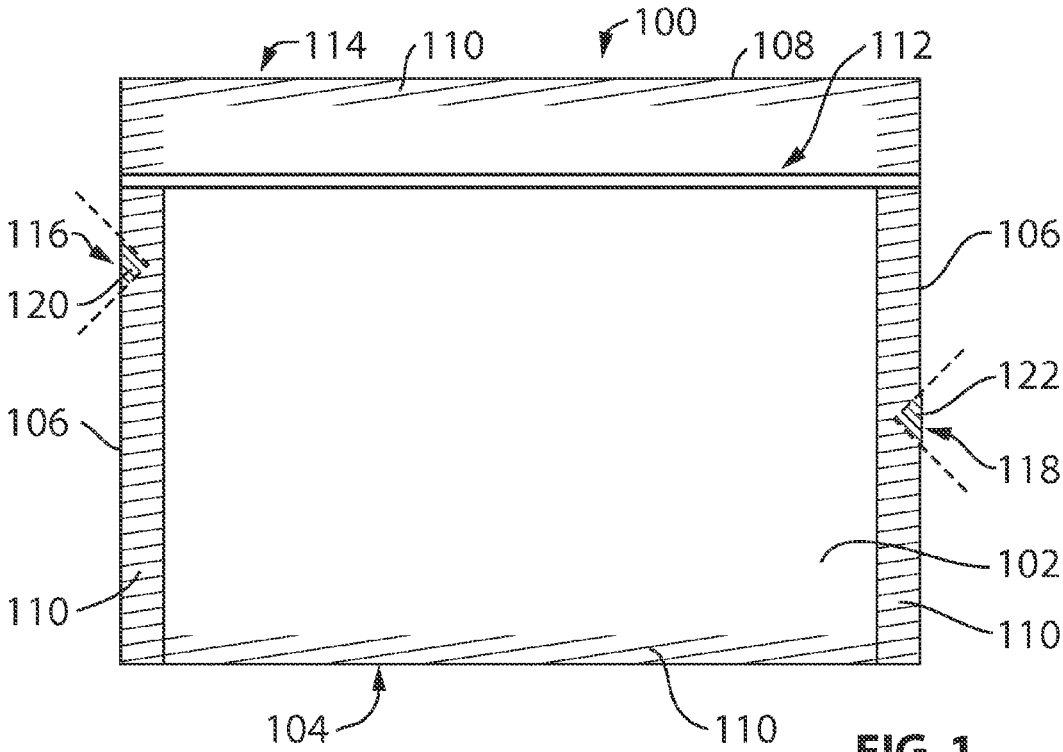
FIG. 1 is a schematic front or back elevation view of a food container in the form of a pouch, in accordance with an embodiment.

In the illustrated embodiment of FIG. 1, the container is formed by two cut out films 102 which are sealed together sealed together at a substantial portion of their respective periphery, or as seen, along their bottom edge 105, side edges 106 and top edge 108.

The sealing along the edges is provided by a seal band 110 (areas in gray tone). It is noted that the container 100 could also be formed by folding a single piece of film 102 at one of the bottom and side edges, 105 or 106, and seal the remaining edges with the seal band 110.

In the illustrated embodiment, the food container 100 has an incorporated closable or reclosable device 112 at a top portion 114 of the pouch, below and along the top edge 108. An example of such a closable or reclosable seal is a zipper structure.

Also in the illustrate embodiment of FIG. 1, the container 100 has weak spots 116 and 118 at specific points (also referred to as pre-defined positions) on the seal band 110. The weak spots 116 and 118 are designed to provide for the venting of steam out of the container 100 during microwaving, thereby preventing the explosion or breakage of the container 100 under pressure build-up. It should be noted that the micro-perforations are not adapted to release steam during cooking. The weak spots are designed for this function.

The weak spot(s) 116 and/or 118 are designed to open the seal band 110 at the specific point, upon an increase combination of temperature and internal pressure occurring during the cooking.

The illustrated weak spots 116 and 118 are created by for example applying heat at the specific locations on the seal band 110 during manufacturing of the container 100; or by cutting out a portion of the seal band 110 to form notches 120 and 122, as illustrated in FIG. 1 by the dashed cut lines and the dark cut out portion forming a respective notch.

Figure 2:
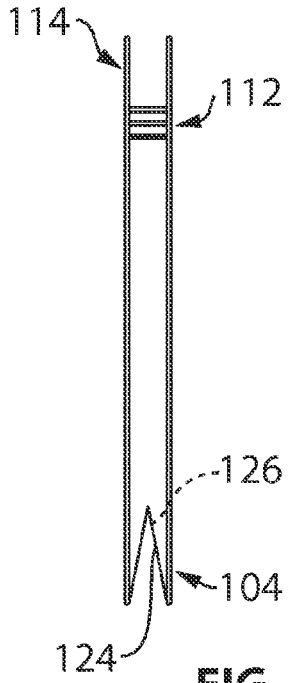
FIG. 2 is a schematic side elevation view of the food container of FIG. 1, in accordance with an embodiment.
Figure 3:
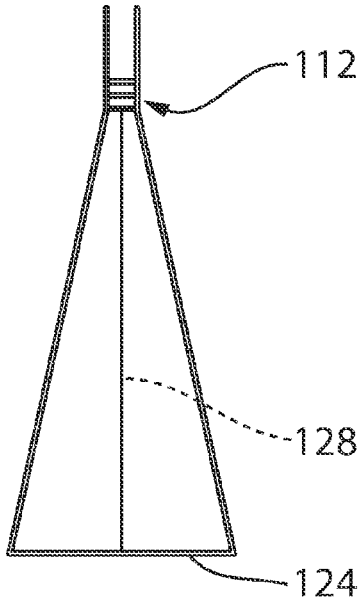
FIG. 3 is a schematic side elevation view of the food container of FIG. 1, once deployed along a bottom fold, in accordance with an embodiment.

Referring to FIGS. 2 and 3, a gusset junction is formed by the container 100 having a bottom polyester film piece 124, with fold lines 126 and 128 allowing for the compression and expansion of the interior volume inside the container 100 to form a pouch.

The container 100 is made to maintain, when sealed external to the closable or reclosable device 112 (i.e. at the seal bands 110), an internal pressure of one atmosphere. In addition, the nature of the film and the seal bands 110 are designed to provide a controlled respiration for products to be contained within the container 100.

Figure 4:
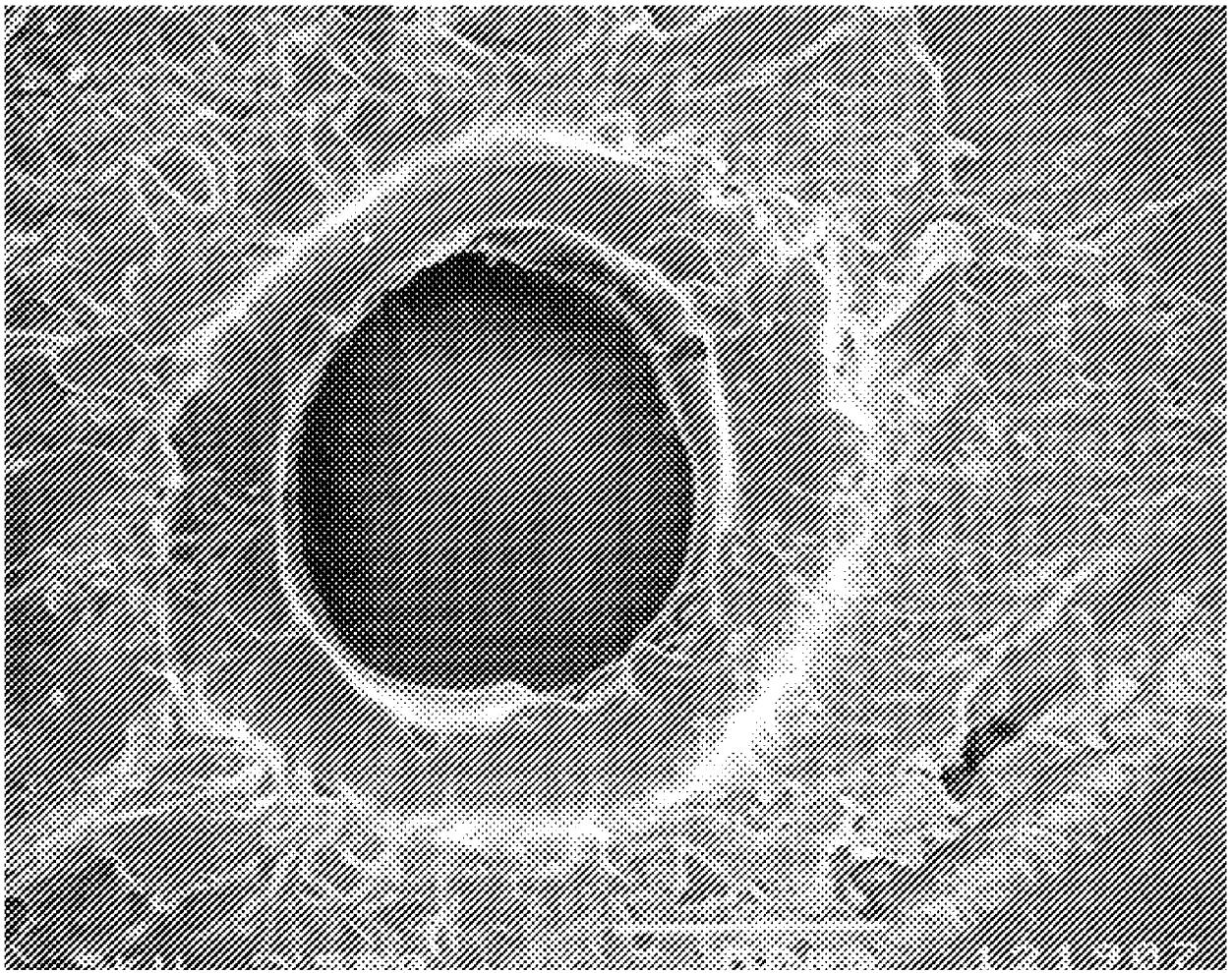
FIG. 4 is an enlarged view of a film material out of which the container of FIG. 1 is made, seen using a microscope, in accordance with an embodiment.

To achieve such controlled respiration and maintain an internal gazeous composition, the polyester film 102 is a heat-sealable film which is chosen, in one embodiment, to be less than 50 microns in thickness. The film 102 also has a number of micro-perforations, as shown in the enlarged view of the film in FIG. 4. The micro-perforations are generally chosen to be of a size less than 85 microns to allow for the controlled retaining of humidity (water vapor molecules) inside the container 100. In one more specific example, the micro-perforations are of a size between 40 and 85 microns. The micro-perforations can be uniformly distributed on the film 102.

It is noted that the size and position of the micro-perforations may further be designed depending on the characteristics of the foodstuff, such as their moisture retention, shape, moisture level, or any other characteristic which may be used in order to design the micro-perforations in such a way as to increase the foodstuff's shelf life once stored in the container 100, or for example, prior to being sold and opened by a purchasing customer.

In one embodiment, the micro-perforations are provided in the film 102 by subjecting the polyester film to a number of small high voltage discharges (intense sparks) which vaporize the polymer at the location of the sparks applied on the film. A film can thus be produced with a very precise respiration rate according to the sizes and shapes of the micro-perforations. According to another embodiment, a laser can be used to produce the micro-perforations.

Referring back to FIGS. 1 to 3, in one embodiment, the container 100 has a sealable opening formed at one of the edges such as the top edge 108 in FIG. 1, to provide an access to any foodstuff stored inside the container 100 during preparation for cooking, or at least prior to cooking; although the herein described container 100 does not necessarily need to be employed for cooking.

In one embodiment, the sealable opening comprises a closable/reclosable seal such as the closable or reclosable device 112 of FIG. 1. Additional foodstuff and/or flavourings may be added to the container 100 and then closed with the closable/reclosable seal. The container 100, with the foodstuff therein, may then be placed in a microwave or other heating device for the cooking to take place.

It is noted that when employed for cooking, the top portion 114 above the closable/reclosable device 112, between the closable/reclosable device 112 and the top edge 108 (refer to the embodiment illustrated in FIG. 1), is able to remain at ambient temperature for safe handling of the container 100 immediately after cooking.

Figure 5A:
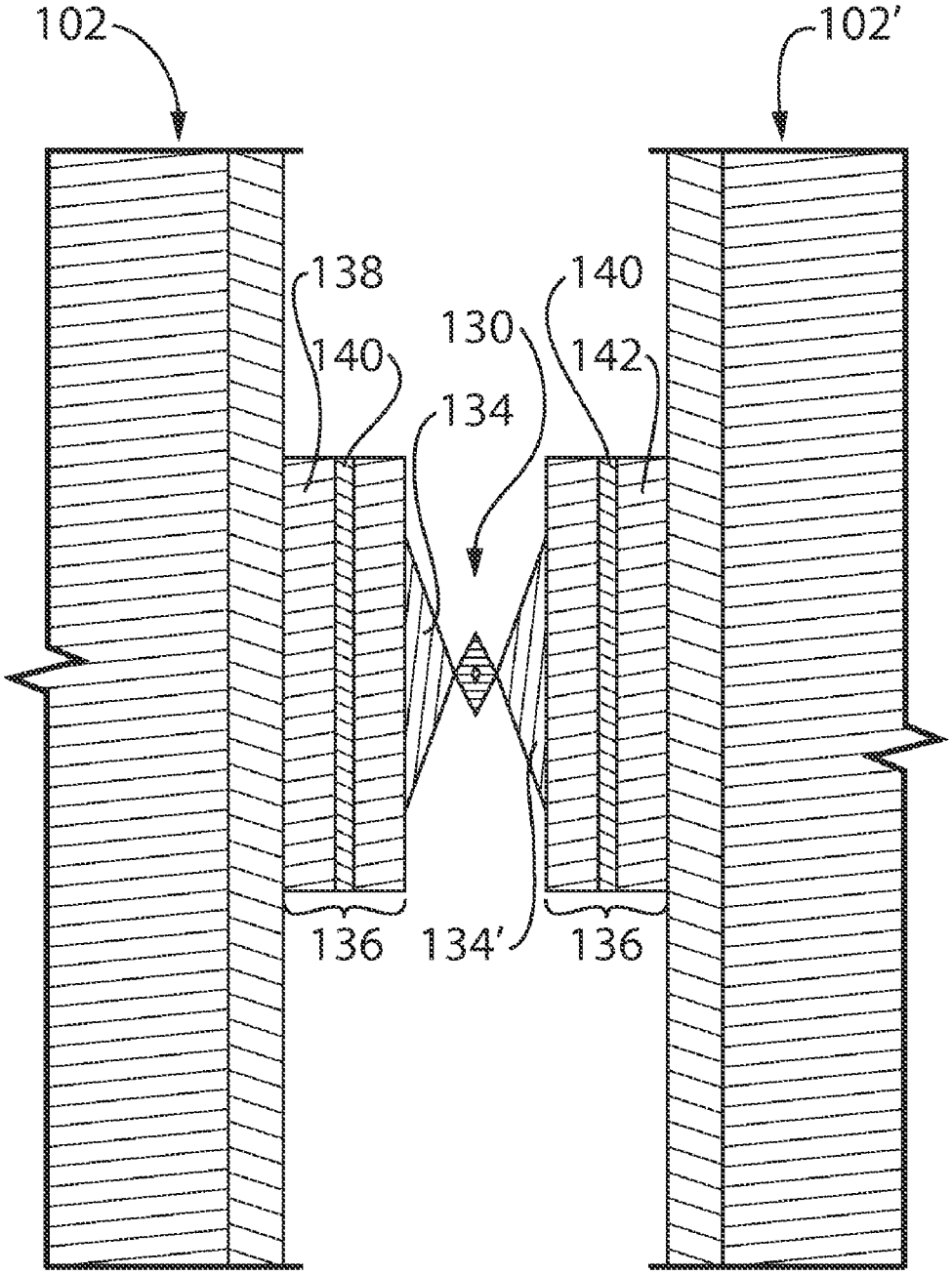
FIG. 5*a* is a schematic illustration of an attachment of a closable/reclosable zipper device to the polyester film of the food container of FIG. 1, using a first type of laminating layer, in accordance with an embodiment.
Figure 5B:
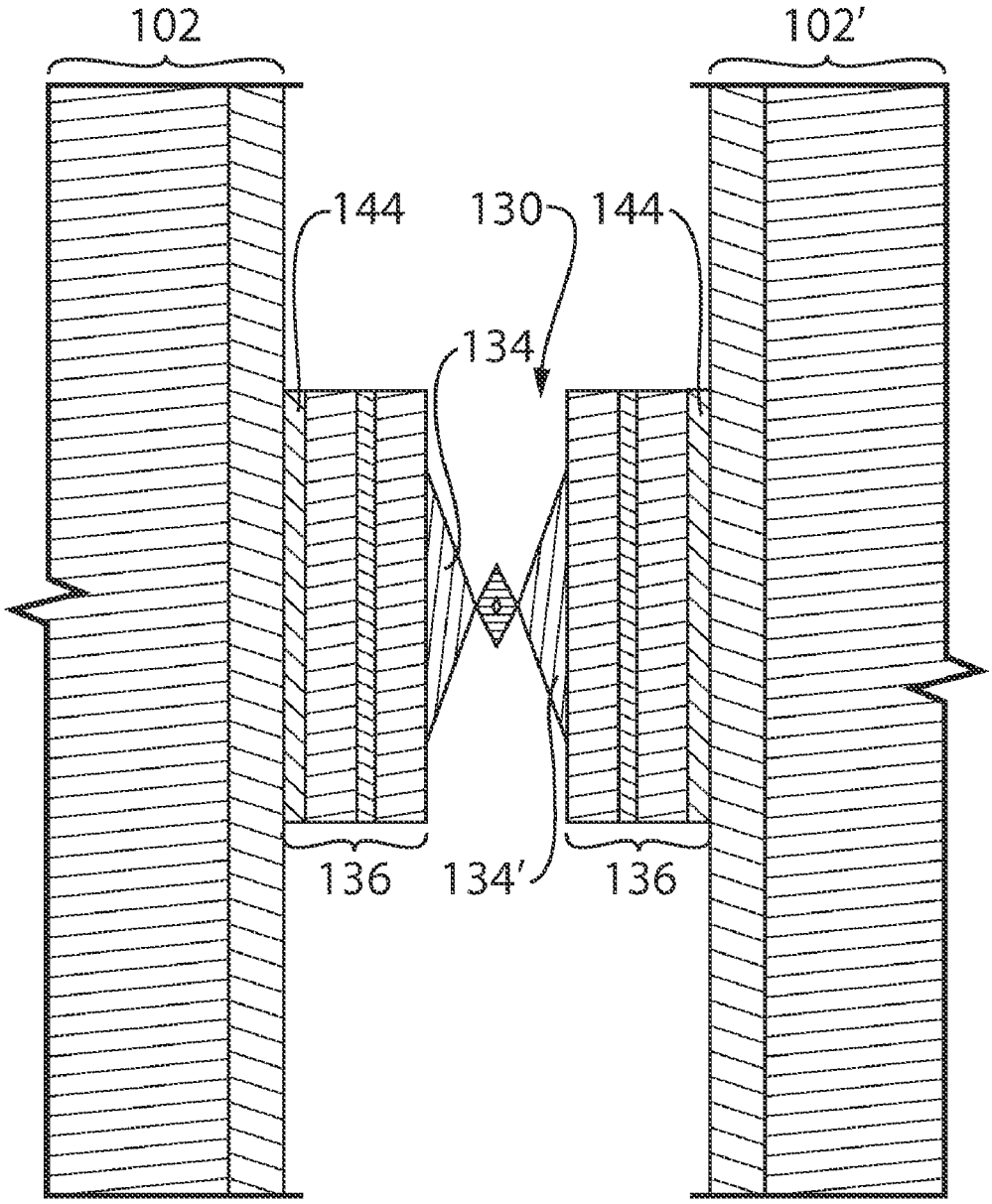
FIG. 5*b* is a schematic illustration of an attachment of a closable/reclosable zipper device to the polyester film of the food container of FIG. 1, using another type of laminating layer, in accordance with an embodiment.
Figure 5C:
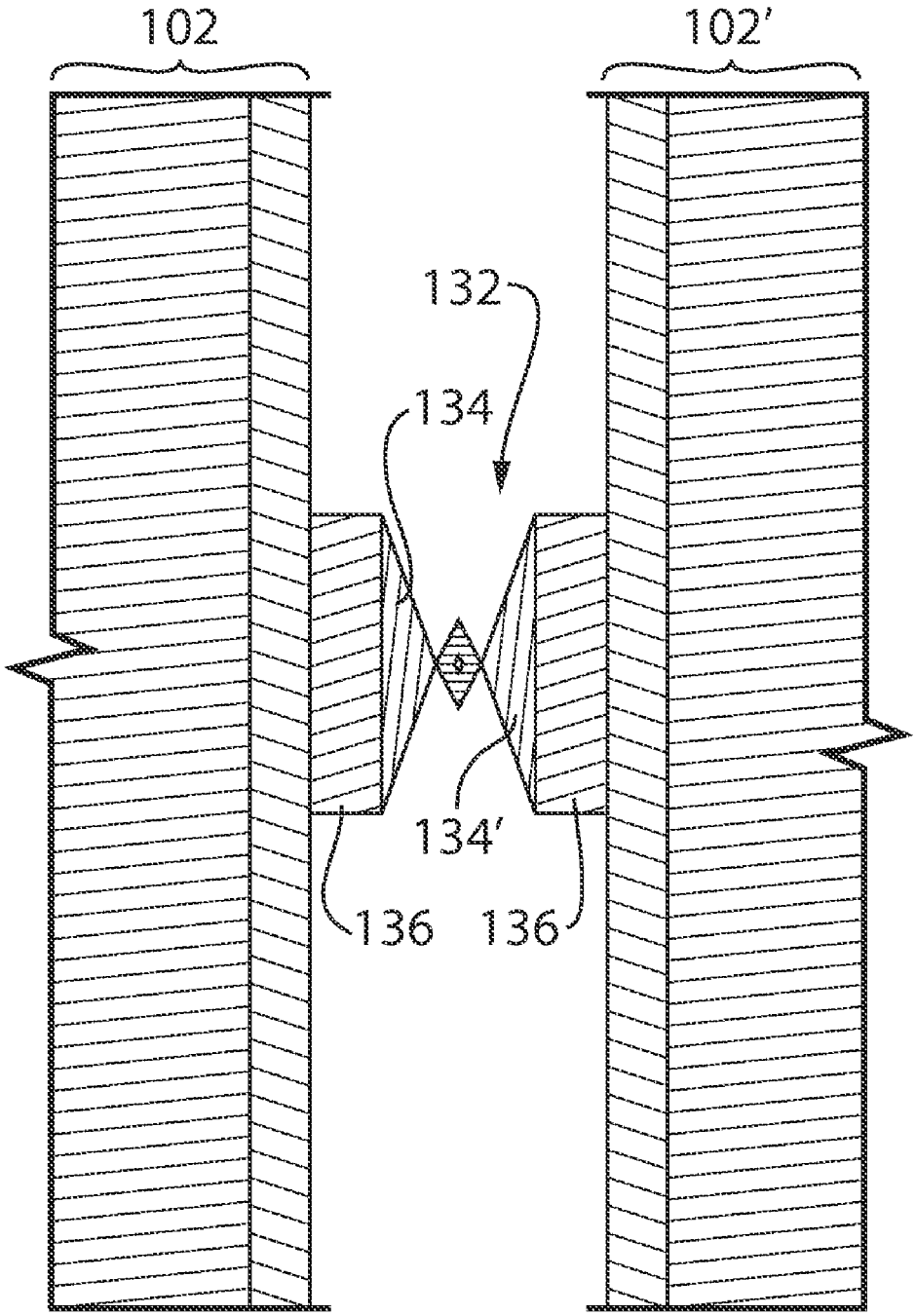
FIG. 5*c* is a schematic illustration of an attachment of a custom closable/reclosable zipper device modified to be compatible for adherence to the polyester film of the food container of FIG. 1, in accordance with an embodiment.

In addition, and with reference to FIGS. 5*a*, 5*b* and 5*c*, the closable/reclosable device 112 (refer to FIG. 1) has, in one embodiment, a polyolefin-based closable/reclosable zipper (130 and 132 in FIGS. 5*a*, 5*b* and 5*c*), which is adhered to the film(s) 102 and 102', interiorly to the pouch formed by the film(s) and seal band(s) 110 (refer to FIG. 1), to allow a sealing or re-sealing of the pouch, as desired.

In one embodiment such as shown in FIGS. 5*a*, 5*b* and 5*c*, the closable/reclosable device has two mutually engageable strips 134, 134' each adhered internally to the pouch. As illustrated in those Figures, a bridging material is used between each one of the strips 134, 134' of the closable/reclosable device such as zippers 130 or 132, and respective polyester film 102, 102'.

The bridging material is any intermediate layer of material, or combination of materials, which allow for a secure attachment of the polyolefin-based closable/reclosable device such as zippers 130, 132, to the polyester films 102, 102'. The attachment is, in one embodiment, made to be moisture-resistant so as to withstand during cooking so as to avoid detachment of the closable/reclosable device under moist pressure.

In FIG. 5*a* for example, the bridging material 136 (also referred to as a bridge layer) is a laminating film which such as a strip of adhesive laminated in a separate process and formed of a polyester layer 138, a laminate layer 140 and a polyethylene layer 142. The polyethylene layer is replaceable with another material layer according to the material composition found in the zipper 130. Once the laminating film is produced, it is bonded to respective zipper strips 134, 134' and films 102, 102'.

In FIG. 5*b*, the bridging material 136 is another type of laminating film such as used in FIG. 5*a*, which also has a heat-activated adhesive coating 144.

In FIG. 5*c*, the bridging material 136 is a sealant layer provided on a flange of the zipper 132. The zipper 132 is a custom closable/reclosable zipper device in that it has been pre-modified prior to its attachment to each of the films 102, 102'. The pre-modification is to render a readily available zipper such as the Eaton™ zipper compatible for adherence to the polyester films 102, 102'. Once modified, the flange of each one of the interlocking (or mutually engaging) strips 134, 134' of the zipper has the sealant layer, which forms the bridging material 136 adapted to adhere to respective films 102, 102'.

In addition to the embodiment shows in FIGS. 5*a*, 5*b*, and 5*c*, the bridging material 136 can be a single layer of adhesive material provided as a coating on the polyester film 102, 102', and then heat-sealed to a strip 134, 134' or the zipper 130.

Figure 6:
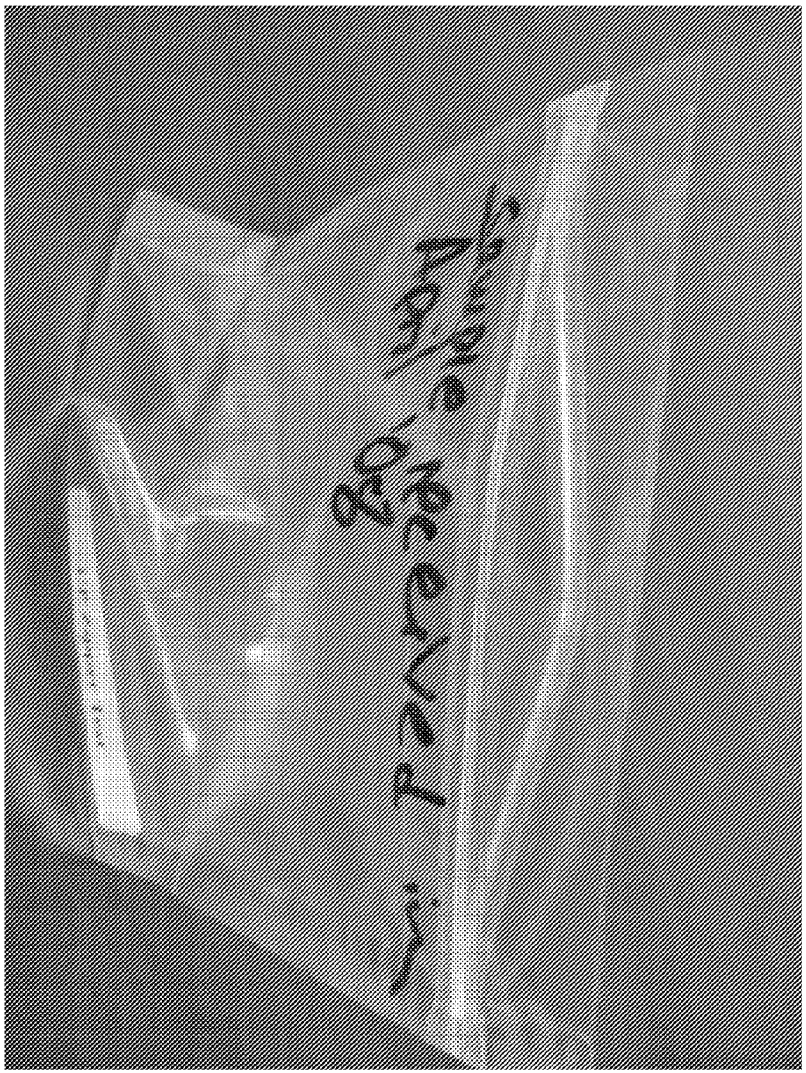
FIG. 6 is a photograph of a food container such as that of FIG. 1, in accordance with an embodiment.
Figure 7:
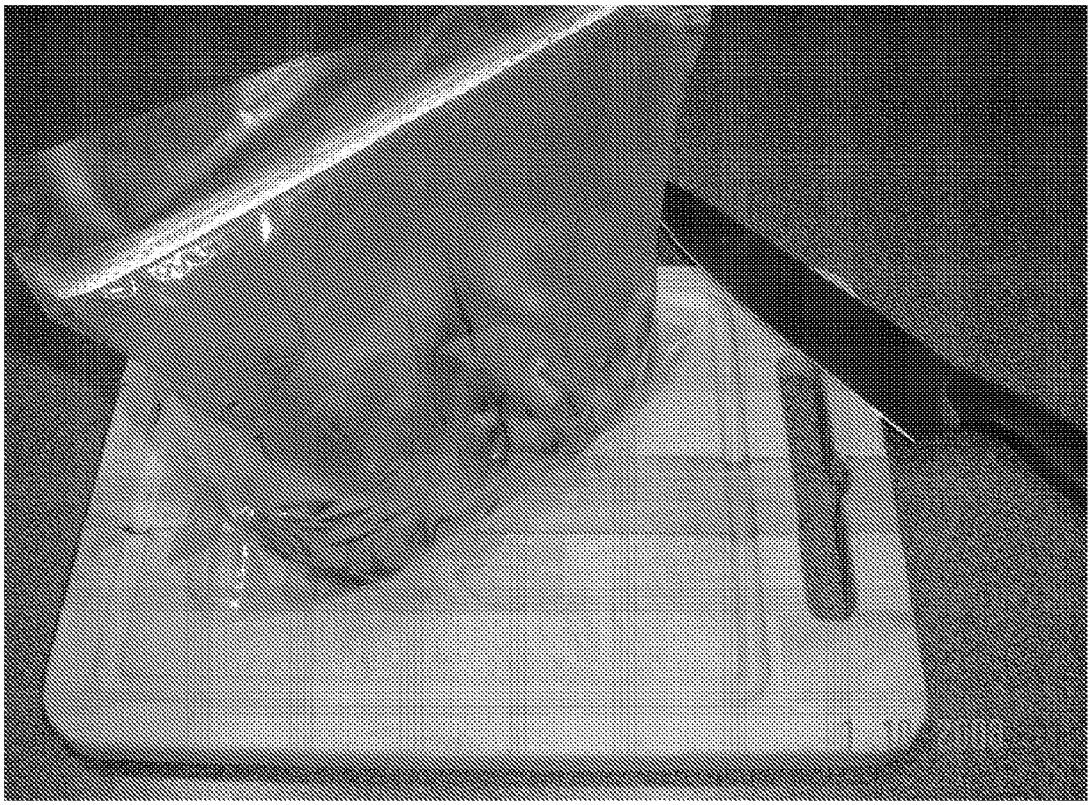
FIG. 7 is a photograph of the food container of FIG. 6, after the cooking of artichokes therein, in accordance with an embodiment.

FIG. 6 is a photograph of a food container such as that of FIG. 1, in accordance with an embodiment, while FIG. 7 is a photograph of the food container of FIG. 6, after the cooking of artichokes enclosed therein, in accordance with an embodiment.

Figure 8A:
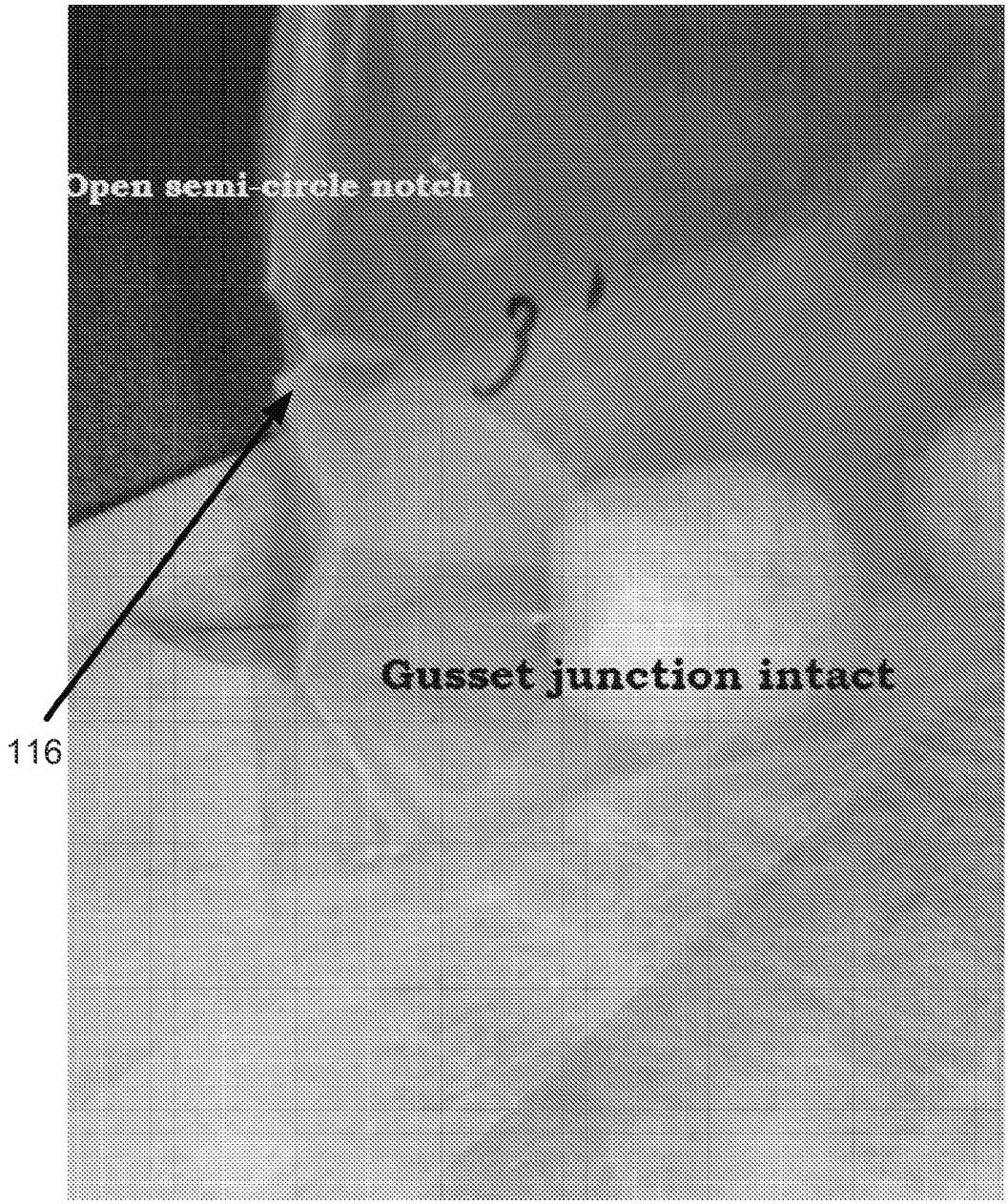
FIG. 8*a* is a photograph of the food container of FIG. 6, after the cooking of a potato, which shows an opening of the pouch at the notch, in accordance with an embodiment.

FIG. 8*a* is a photograph of the food container of FIG. 5, after the cooking of a potato (not shown), which shows an opening of the pouch at the notch, in accordance with an embodiment.

During cooking, the pressure build-up inside the pouch ruptures the notch (i.e. weakens the seal band such that is flexes and releases). For example, a seal band of a 7/16 inch width with a 1/8 inch notch will weaken and open during cooking under a pressure buildup created by water vapor inside the package.

In addition to releasing pressure, avoiding the container from opening by a de-lamination of the closable/reclosable device or an opening at a gusset junction for example, weak spot(s) such as the illustrated notch(s) are provided at pre-defined locations on the package, and with pre-determined shapes which best suit the characteristics of the foodstuff (i.e. such as, but not limited to, the foodstuff's water content, cooking behavior, size and shape). The specific locations of the weak spot(s) as well as their shape ensure that the seal band will always open at that location during cooking.

The presence of the weak spot(s) also provide for a uniform pressure in the container during cooking, prevents the top portion of the container to become hot above the closable/reclosable device, and is placed sufficiently high above the bottom of the container to ensure mitigation or avoidance of spilling of liquid during cooking. It has been found that the shape of the openings thereby formed from the weak spot(s) (such as notches) are useful in preserving of the package's general shape during cooking. For example, as seen in FIG. 8*b*, the gusset junction of the pouch is still intact after the cooking.

Figure 8B:
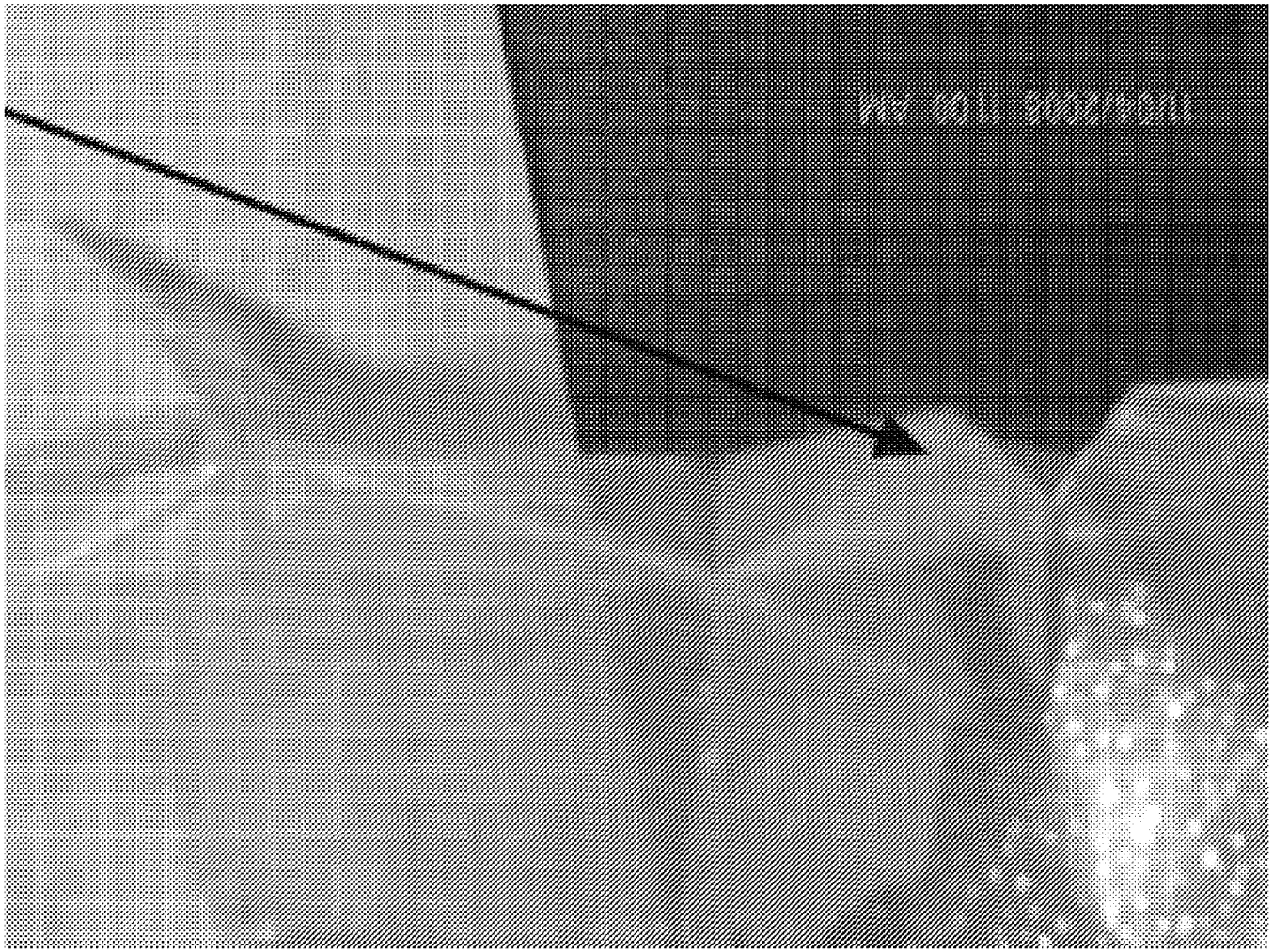
FIG. 8*b* is another photograph of the food container with the potato as in FIG. 8*a*, which shows an opening created by a semi-circular notch, with the gusset junction intact, in accordance with an embodiment.

In addition, still in reference to FIG. 8*b*, a semi-circular or round reduction in thickness (or weakness) in the seal band 110 of the container 100 (refer also to FIG. 1) forms a circular opening. Such a semi-circular or round shaped reduction has been found to allow a ballooning of the pouch during cooking so as to fold back on itself along a side or vertical edge of the pouch. It is however noted that the shapes of the weak spot(s) and notches can take any form, semi-circular, triangular, rectangular, trapezoidal, elliptical, and so on.

There has been described a food container or package which is intended but not limited to the packaging of fresh foods that are best kept under pre-defined respiration rates to maximize their respective shelf lives. In addition, when desired by the end user or customer, the package with the product therein, can be placed directly in the microwave for cooking.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A cooking container for foodstuff in the form of a pouch made of a microwaveable heat-sealable polyester film, the polyester film comprising:

micro-perforations allowing controlled respiration of the film while maintaining atmospheric pressure inside the pouch;

a sealable opening providing access to the foodstuff at least prior to cooking, the sealable opening comprising a reclosable zipper, the reclosable zipper comprises two mutually engageable strips; and a bridging material between the two mutually engageable strips of the reclosable zipper and the polyester film.

2. The cooking container of claim 1, wherein the micro-perforations are of a size less than 85 microns.

3. The cooking container of claim 1, wherein the micro-perforations are of a size between 40 and 85 microns.

4. The cooking container of claim 1, wherein the film has a thickness less than 50 microns.

5. The cooking container of claim 1, wherein the micro-perforations are uniformly distributed on the film.

6. The cooking container of claim 1, where a size and position of the micro-perforations are dependent on characteristics of the foodstuff.

7. The cooking container of claim 1, wherein the reclosable zipper comprises a polyolefin-based material.

8. The cooking container of claim 7, wherein the bridging material is between the polyolefin-based material of the reclosable seal and the polyester film.

9. The cooking container of claim 8, wherein the bridging material comprises at least one of: a strip of adhesive laminated layer; a heat-activated adhesive coating; and a sealant layer provided on a flange of a pre-modified reclosable zipper structure.

10. The cooking container of claim 1, the film comprising a weak spot creating an opening under an increase in pressure inside the pouch during microwave cooking.

11. The cooking container of claim 1, wherein the film comprises an edge and wherein the edge comprises a seal band.

12. The cooking container of claim 11, further comprising a weak spot in the seal band, the weak spot creating an opening under an increase in pressure inside the pouch during microwave cooking.

13. The cooking container of claim 12, wherein the weak spot comprises a notch.

14. The cooking container of claim 13, wherein the notch comprises at least one of a semi-circular shape and a triangular shape.

15. A container for foodstuff in the form of a pouch made of a heat-sealable polyester film, the polyester film comprising micro-perforations allowing controlled respiration of the film while maintaining atmospheric pressure inside the pouch, the container comprising a polyolefin-based reclosable zipper adhered to the polyester film to allow re-sealing of the container.

16. The cooking container of claim 1, wherein the bridging material is resistant to moisture.

17. The cooking container of claim 1, wherein the bridging material comprises a polyester layer laminated to a polyethylene layer.

18. The cooking container of claim 17, wherein the bridging material further comprises a heat-activated adhesive coating between the polyester layer and the polyester film.

19. The cooking container of claim 1, wherein the bridging material comprises a heat-activated adhesive coating.

20. A cooking container for foodstuff in the form of a pouch made of a microwaveable heat-sealable polyester film, the polyester film comprising:

a sealable opening providing access to the foodstuff at least prior to cooking, the sealable opening comprising a reclosable zipper, the reclosable zipper comprises two mutually engageable strips; and a bridging material between the two mutually engageable strips of the reclosable zipper and the polyester film.

* * * * *